United States Patent [19]

Nishiki et al.

[11] Patent Number: 4,935,110

[45] Date of Patent: Jun. 19, 1990

[54] ELECTRODE STRUCTURE AND PROCESS FOR FABRICATING THE SAME

[75] Inventors: Yoshinori Nishiki; Shuji Nakamatsu, both of Kanagawa; Takayuki Shimamune, Tokyo, all of Japan

[73] Assignee: Permelec Electrode Ltd., Kanagawa, Japan

[21] Appl. No.: 276,732

[22] Filed: Nov. 28, 1988

[30] Foreign Application Priority Data

Nov. 27, 1987 [JP] Japan ..... 62-297674
Nov. 27, 1987 [JP] Japan ..... 62-297675

[51] Int. Cl.[5] ..... C25D 5/54; C25D 15/00; C25B 11/16; C25B 11/20

[52] U.S. Cl. ..... 204/20; 204/38.4; 204/56.1; 204/290 R; 204/291; 204/294; 502/159; 502/174; 502/300

[58] Field of Search ..... 214/20, 56.1, 282, 283, 214/291, 294, 296, 290 R; 502/159, 174, 300

[56] References Cited

U.S. PATENT DOCUMENTS 4,008,144 2/1977 Torikai et al. ..... 204/291

4,326,930 4/1982 Nagel et al. ..... 204/20

*Primary Examiner*—John F. Niebling
*Assistant Examiner*—Kathryn Gorgos
*Attorney, Agent, or Firm*—Sughrue, Mion, Zinn, Macpeak & Seas

[57] ABSTRACT

Electrode structures of solid polymer electrolyte type for use in electrolysis are disclosed, (i) in which an adhering layer containing fine particles loaded with a $\beta$-lead dioxide powder is formed on one surface of an ion-exchange membrane serving as a solid polymer electrolyte, and an electrodeposited layer of lead dioxide being formed on the surface of the adhering layer, and (ii) in which an electrodeposited layer of lead dioxide having dispersed therein fine particles loaded with a $\beta$-lead dioxide powder is formed electrolytically between an ion-exchange membrane serving as a solid polymer electrolyte and a current collector positioned close to the ion-exchange membrane, to thereby form a unitary assembly. The present electrode structures are useful for production of ozone by electrolysis of water and for production of peroxides by electrolysis of aqueous solutions.

15 Claims, No Drawings

ELECTRODE STRUCTURE AND PROCESS FOR FABRICATING THE SAME

FIELD OF THE INVENTION

The present invention relates to an electrode structure for use in electrolysis. More particularly, the present invention relates to an electrode structure adapted for use in high-potential electrolytic oxidation reactions such as those involved in ozone production by electrolysis of water, peroxide production by electrolysis of aqueous solutions and electrolytic oxidation of organic matter. The present invention also relates to a process for fabricating such electrode structures.

BACKGROUND OF THE INVENTION

In the modern electrolytic industry, soluble electrodes typified by carbon electrodes are being replaced by those electrodes which have electrode active materials. In particular, oxides of platinum group metals, coated on substrates made of titanium or titanium alloys, are very stable under anodic polarization conditions. These electrodes, generally referred to as dimensionally stable anodes (DSA) or dimensionally stable electrodes (DSE), have such superior electrolytic characteristics and durability that they are currently employed in a number of industrial electrolytic processes including the generation of oxygen gas by electrolysis of water, as well as the production of halides and alkali hydroxides by electrolysis of aqueous solutions of metal halides, as disclosed in U.S. Pat. Nos. 3,711,385 and 3,632,498.

Anode materials also play an important role in the production of ozone gas or peroxides utilizing the oxidation reaction involved in anode electrolysis, as well as in other types of electrolysis such as the electrolytic oxidation of organic matter. However, the electrolytic reaction involved in the production of ozone gas and peroxides requires such a high potential that other types of electrolytic reactions which proceed at lower potentials will take place preferentially even if the above-described DSAs are employed. In other words, DSAs are not suitable for the electrolytic production of ozone gas or peroxides with the only exception limited to platinum-coated titanium electrodes.

In view of the need to search for an anode active material that can substitute for DSAs and to improve the efficiency of operations in electrolysis involved in the production of ozone gas and peroxides, various studies have been conducted not only with respect to electrode materials but also in regard to the structure of electrodes and electrolytic cells. Electrode materials of lead, lead oxide and carbon have been studied.

In the anodization processes described above, electrolysis is normally performed with the catholyte and anolyte being separated by a diaphragm in order to prevent reduction from occurring at the cathode. This approach, however, has disadvantages in that a voltage drop occurs due to the electrical resistance of electrolyte present between anode and cathode and that the electrode area cannot be made large enough to ensure high current density. In order to solve these problems, an SPE (solid polymer electrolyte) process has been proposed in which a diaphragm formed of an ion-exchange member is coated with an electrode active material so as to substantially eliminate the Ohmic loss due to the electrolyte.

This SPE process is also applicable to the production of ozone and peroxides by anodic electrolytic oxidation, and an electrolytic apparatus adapted to the SPE process can be fabricated using lead, lead oxide or carbon as an electrode active material. One of the problems associated with the use of an SPE in electrolysis concerns the electrical connection between the current collector and the SPE. The amount of current that can be supplied will increase with the area of contact between the collector and the electrode active material deposited on the membrane. However, collectors are usually porous, and the electrode active material does not adhere very strongly to the membrane. Thus, it is impossible to connect these members over a large contact area without causing Ohmic loss due to the contact between them. Therefore, it is of great importance to find an efficient way for supplying power to the SPE.

Problems also occur if the conventional process for the fabrication of SPEs is directly applied to the production of SPEs using lead, lead dioxide or carbon as an electrode active material. In order to ensure that fine particles are firmly adhered to an ion exchange membrane by hot pressing, temperatures on the order of 350° C. are necessary but partial decomposition of lead dioxide might occur at these temperatures. A method is also known that involves electrodeposition of the particles of an electrode active material. However, this method has disadvantages in that it is difficult to obtain an adequate thickness of coating and that the electrode active material gets into the bulk of an ion-exchange membrane unevenly thus potentially causing side reactions. A technique based on electroless plating is also defective in that control of the plating process is difficult and that an unduly long time is required to perform plating.

With a view to improving the above-described methods of SPE production, it has been proposed that a sintered titanium substrate be coated with lead dioxide to form an electrode, which then is adhered closely to an ion-exchange membrane [J. Elec. Chem. Soc., 132 (1985), P. 367 ff.]. This method, however, lacks production efficiency with respect to the difficulty in forming a titanium sinter. U.S. Pat. No. 4,416,747 proposes a way to solve this problem by forming a layer of fine lead dioxide particles and an organic binder on the surface of a cation-exchange membrane. This approach is effective if an appropriate organic binder is chosen but insufficient activity of the electrode active material is observed because the binder will mask the fine particles of lead dioxide which serve as the active material. Furthermore, it is considerably difficult in practice to select a binder having good adhesion and high durability.

SUMMARY OF THE INVENTION

An objective of the present invention is to provide an electrode structure of the SPE type having a thick coating of electrode active material coating with superior activity. This is accomplished by ensuring that a lead dioxide based electrode active material will not be unevenly penetrated into an ion-exchange membrane when a layer of the material is forming on the membrane.

A second object of the present invention is to provide an electrode structure of the SPE type in which a current collector for supplying power to an SPE, that the electrode structure chiefly having $\beta$-lead dioxide as an electrode active material, is connected to the ion-exchange membrane on the SPE in substantial absence of Ohmic loss so as to ensure a predetermined activity.

A third object of the present invention is to provide a process for fabricating the electrode structure described above.

One aspect of the present invention relates to an electrode structure of the solid polymer electrolyte type for use in electrolysis in which an adhering layer having fine particles containing β-lead dioxide powder is formed on one side of a fluorine-base ion-exchange membrane serving as a solid polymer electrolyte, with an electrodeposited layer of lead dioxide being formed on the surface of said adhering layer.

Another aspect of the present invention relates to an electrode structure of the solid polymer electrolyte type for use in electrolysis in which an electrodeposited layer of lead dioxide having dispersed therein fine particles containing a β-lead dioxide powder is formed electrolytically between an ion-exchange membrane serving as a solid polymer electrolyte and a current collector positioned close to the ion-exchange membrane, thereby connecting said ion-exchange membrane and the current collector to form a unitary assembly.

An additional aspect of the present invention relates to a process for fabricating an electrode structure of the solid polymer electrolyte type for use in electrolysis which comprises the steps of: positioning a current collector close to an ion-exchange membrane serving as a solid polymer electrolyte; positioning a counter-electrode on the side of the ion-exchange membrane which is remote from the current collector serving as an anode; performing electrolysis using as an electrolyte a lead salt solution having particles of β-lead dioxide suspended therein, so as to form an electrodeposited layer of lead dioxide in which fine particles containing the particles of β-lead dioxide are dispersed, thereby connecting the ion-exchange membrane and the current collector by the electrodeposited layer of lead dioxide to form a unitary assembly.

DETAILED DESCRIPTION OF THE INVENTION

Any conventional ion-exchange membrane can be used as a solid polymer electrolyte in the present invention. For example, fluorinated hydrocarbon resin type ion-exchange membranes are durable and easy to work. The choice of the ion-exchange membranes depends on the specific use of the electrode structure of the present invention. For example, an ion-exchange membrane of the perfluorosulfonic acid type is suitable for use in the electrolytic production of ozone. In order to improve the adhesion of an electrodeposited layer of lead dioxide onto an ion-exchange membrane the surface of the ion-exchange membrane is preferably roughened by a preliminary treatment such as filing or ion sputtering.

According to the first aspect of the present invention, an adhering layer having fine particles containing a β-lead dioxide powder is formed on an ion-exchange membrane serving as a solid polymer electrolyte before an electrodeposited layer of lead dioxide is formed on said membrane. The adhering layer prevents the active material from being unevenly penetrated into the ion-exchange membrane during the process of electrodeposition, thereby not only avoiding side reactions but also improving the current efficiency without employing operations such as hot pressing that have caused adverse effects on the membrane quality in the prior art.

There is no particular limitation on the method that can be employed to form the adhering layer having fine particles containing a β-lead dioxide powder. According to one method, a slurry containing a β-lead dioxide powder is coated on the surface of an ion-exchange membrane that has been subjected to a pretreatment of the kind described above (e.g., filing, ion sputtering), and the coating is adhered to the membrane by drying either at ambient temperature or at higher temperatures. Alternatively, the particles of β-lead dioxide may be adhered to the ion-exchange membrane by hot pressing.

The particle size of the β-lead dioxide powder may be properly selected in accordance with the specific use of the electrode structure of the present invention. A desirable particle size is in the range of 100 to 425 mesh (Tyler mesh; hereinafter the same), i.e., about 150 to 30 82 . If the particle size of the β-lead dioxide powder is finer than 425 mesh, the gas permeability of the adhering layer will be somewhat impaired. On the other hand, if the particle size of the powder is larger than 100 mesh, the adhesion of the resulting layer will be impaired.

The adhering layer under discussion may be formed of β-lead dioxide particles alone. If desired, an electrolytic cocatalyst may be incorporated in this layer depending on the specific use of the final electrode structure. An electrolytic cocatalyst, if used at all, is preferably present in an amount of 0.1 to 20 wt % of β-lead dioxide. For ozone production, fluorine resins, ion-exchange resins of the perfluorosulfonic acid type or the particles of fluorinated carbon are advantageously used as electrolytic cocatalysts. For peroxide production, oxide of valve metals such as titanium, zirconium, niobium and tantalum are preferred. For electrolytic oxidation of organic matter, carbon is also suitable in addition to the above described substances. These electrolytic cocatalysts have the additional advantage of promoting gas diffusion. The fluorine resin and ion-exchange resins of the perfluorosulfonic acid type described above will not only serve as cocatalysts in electrolysis but also provide stronger adhesion to the ion-exchange membrane.

After forming the adhering layer in the manner described above, an electrodeposited layer of lead dioxide is formed on the adhering layer by electrolysis not only to reinforce the adhering layer but also to provide a larger electrode area so that a capability equivalent to that of a three-dimensional electrode will substantially be attained. The electrodeposited layer contains lead dioxide as a chief component and it may be of any desired form but is preferably in the form of β-lead dioxide in consideration of electrical conductivity and durability. This electrodeposited layer may typically be formed using an aqueous solution of lead nitrate as an electrolyte under acidic conditions at a temperature of 50° to 70° C. and at a current density of 0.1 to 1.0 $A/dm^2$ utilizing as an anode the ion-exchange membrane having formed thereon the adhering layer containing the β-lead dioxide powder. By electrolysis of the lead nitrate, β-lead dioxide is generated and deposited on the adhering layer. In forming the layer of β-lead dioxide, the area surrounding the adhering layer is desirably masked with a seal so that lead dioxide will be precipitated only in the area where said adhering layer is present.

By suspending the particles of β-lead dioxide in the aqueous lead nitrate electrolyte, an electrodeposited layer containing the particles of β-lead dioxide can be formed. Such particles in the electrodeposited layer are effective in providing a further increased area for electrolysis and in rendering it porous, thereby providing an electrode structure that has improved gas permeability. The suspended particles are desirably the same in composition as the component in the adhering layer but may be of a different composition. The suspension may also contain fine particles of the electrolytic cocatalyst described above. The preferred amount of such cocatalyst ranging from 0.1 to 20 wt % of β-lead dioxide. The content of all particles in the electrodeposited layer is desirably not more than 60 vol %, and if this upper limit is exceeded, the physical strength of the layer may be impaired.

The particles of β-lead dioxide can be incorporated in the electrodeposited layer of lead dioxide by various methods including "suspension plating" which involves electrodeposition of β-lead dioxide particles suspended in the electrolyte, and a method in which the electrodeposition of lead dioxide alternates with application of a paste containing the particles of β-lead dioxide.

The electrode structure fabricated by the procedures described above has good gas permeability. The adhering layer formed on an ion-exchange membrane prevents uneven penetration of the electrodeposited lead dioxide into said ion-exchange membrane. At the same time, the electrodeposited layer provides a three-dimensional spread of the principal electrode active material.

In an electrode structure of the SPE type for use in electrolysis which is produced in accordance with the first aspect of the present invention, an adhering layer containing fine particles loaded with a β-lead dioxide powder is formed on one surface of an ion-exchange membrane, and an electrodeposited layer of lead dioxide in which fine particles containing a β-lead dioxide powder may optionally be dispersed is formed on the surface of the adhering layer. The powder of β-lead dioxide is an electrode active material having a higher overpotential than oxides of platinum group metals, such that the electrode structure of the present invention is useful in various types of electrolysis such as the production of ozone by electrolysis of water, the production of peroxides by electrolysis of aqueous solutions and in the electrolytic oxidation of organic matter. These types of electrolysis require higher cell voltages than needed for the production of alkali hydroxides by electrolysis of alkali halides, or in the production of oxygen and hydrogen by electrolysis of water.

Having the arrangement described above, the electrode structure of the present invention offers the following advantages. First, the adhering layer containing fine particles loaded with a β-lead dioxide powder blocks the lead dioxide in the electrodeposited layer of an electrode active material, thereby substantially eliminating the chance of the lead dioxide being unevenly penetrated into the ion-exchange member during an electrodepositing operation. As a result, the adhesion between the electrodeposited layer, the adhering layer and the ion-exchange membrane is improved; while at the same time, the occurrence of side reactions is inhibited to prevent a drop in current efficiency. This contributes to a substantial extension of the useful life of the ion-exchange membrane and the overall system incorporating that membrane.

Secondly, the electrode structure of the present invention can be produced without heat-treating an ion-exchange membrane at elevated temperatures. Therefore, this electrode structure is free from thermal deterioration of the ion-exchange membrane and provides a higher degree of ruggedness.

Thirdly, the electrode structure of the present invention has a substantially three-dimensional extended electrodeposited layer which increases the area over which the reactants can make contact with the electrode active material, thereby contributing to an improvement in current efficiency and a reduction in cell voltage.

Fourthly, the presence of both the adhering layer and the electrodeposited layer facilitates the formation of a more uniform layer of the active material.

Fifthly, the porosity of the adhering layer and/or the electrodeposited layer and the degree of its gas permeability can be controlled by incorporating particles in these layers. Therefore, an electrode apparatus that is adapted for specific uses can be easily fabricated.

The second and third aspects of the present invention are an improvement of the existing concept characterized by forming an electrodeposited layer of lead dioxide serving as an electrode active material on the surface of an ion-exchange membrane (a solid polymer electrolyte) to which power is supplied by means of a current collector. A unique aspect of the present invention is that an electrodeposited layer of lead dioxide that serves not only as an electrode active material but also as a connector between the ion-exchange membrane and the current collector is formed between these two members by electrolysis. This provides a unitary assembly of the ion-exchange membrane, the electrode active material and the current collector.

As in the first aspect, an adhering layer containing a powder of β-lead dioxide may be formed on the surface of an ion-exchange membrane which serves as a solid polymer electrolyte. In this regard, an electrolytic cocatalyst may be incorporated in this adhering layer.

A current collector is positioned close to the ion-exchange membrane and an electrodeposited layer of lead dioxide is formed between these two members by electrolysis. The type of current collector to be employed is not limited in any particular way but porous or mesh structures of valve metals such as titanium, zirconium, niobium and tantalum and alloys thereof which are easy to handle and have good corrosion resistance are preferably used as substrates. In order to provide improved adhesion of the electrodeposited lead dioxide and to ensure consistent power supply, the substrates are commonly pretreated by depositing thereon platinum group metals or oxides thereof, or β-lead dioxide or α-lead dioxide.

The current collector and the ion-exchange membrane between which a layer of lead dioxide is to be electrodeposited are desirably spaced apart by a distance of about 5 mm or less. If the distance is greater than 5 mm, it becomes difficult to form a lead dioxide layer on the surface of the ion-exchange membrane, and the adhesion between the current collector and the ion-exchange membrane will be impaired.

In the next step, electrolysis is performed in a two-chamber electrolytic cell with the current collector being used as an anode with a counter electrode being positioned close to the ion-exchange membrane on the side opposite from the collector. The anode compartment is filled with an electrolyte which is an aqueous solution of lead nitrate having a concentration of 200 to 500 g/l, and the cathode compartment is filled with either the same aqueous solution of lead nitrate or some other electro-conductive solution. At the same time, fine particles mainly comprising a β-lead dioxide powder are suspended in the electrolyte in the anode compartment. The β-lead dioxide powder is preferably suspended in an amount of from 3 to 30 wt % in the electrolyte. Depending on the specific use of the electrode structure to be fabricated, the size of said particles is preferably in the range of 100 to 425 mesh. If the particle size is finer than 425 mesh, the gas permeability of the lead dioxide layer will be slightly impaired. If the particles are coarser than 100 mesh, the adhesion of the electrodeposited layer will be reduced. The fine particles to be suspended are chiefly composed of a β-lead dioxide powder for the following reasons: β-lead dioxide itself has catalytic activity; it is highly resistant to corrosion in various solvents; and it is a very good electrical conductor ($\sigma$=ca. $10^{-4}$ Ωcm). Of the two types of lead dioxide available, α-lead dioxide is less corrosion-resistant and less conductive than β-lead dioxide. Therefore, β-lead dioxide should be the major component of the particles suspended in the electrolyte.

A layer of lead dioxide is electrodeposited using an electrolyte having the above-described fine particles suspended therein. Preferred conditions for electrolysis are as follows: the temperature is between 40° to 80° C., preferably 50° to 70° C.; the pH of the electrolyte is no more than 3; and the current density is 1 to 10A/dm$^2$. By performing electrolysis under these conditions, a porous and rugged electrodeposited layer of lead dioxide is formed. According to the usual practice of electrodeposition of lead dioxide, copper ions are added to the electrolyte but this is not recommended for the purposes of the present invention.

The electrodeposited layer generally has about 20 wt % or more of the β-lead dioxide powder dispersed therein and it may be soley formed of a β-lead dioxide powder. Depending on the specific use of the electrode structure to be fabricated, however, the particles of an electrolytic cocatalyst and materials for promoting gas diffusion may be incorporated as in the adhering layer. Suitable electrolytic cocatalysts are either the same as or similar to those employed in the adhering layer, and such cocatalysts also have the ability to promote gas diffusion. Electrolytic cocatalysts or other materials for promoting gas diffusion may be incorporated in the lead dioxide layer by on of the following methods: the particles of the material to be incorporated are first impregnated in a β-lead dioxide powder, which then is electrodeposited on the ion-exchange membrane by electrolysis; alternatively, such particles are suspended in the electrolyte so that they are electrodeposited simultaneously with the β-lead dioxide powder.

The particles of an electrolytic cocatalyst desirably assume 5 to 70 vol % of the electrodeposited layer. If their proportion is less than 5 vol %, the cocatalyst quantity is insufficient to render the lead dioxide layer porous enough to provide an increased surface area. If their proportion exceeds 70 vol %, the electrodeposited layer will not have sufficient mechanical strength, and the adhesion between the ion-exchange membrane and current collector will be reduced.

The electrode structure fabricated by the procedures described herein has an ion-exchange membrane connected electrically to a current collector by a lead dioxide layer to form a unitary assembly. When this structure is assembled in an electrolytic cell, reliable contact is assured between each current collector and the lead dioxide layer serving as an electrode active material, thereby obviating the need to install a separate means for maintaining contact between the two members. In addition, there are no fluctuations in the current value which would otherwise occur in the presence of marginal contact, and a constant supply of electric current is, thus, ensured enabling consistent electrolysis operations.

According to the second and third aspects of the present invention, an electrodeposited layer of lead dioxide having dispersed therein fine particles containing a β-lead dioxide powder is formed electrolytically between an ion-exchange membrane serving as a solid polymer electrolyte and a current collector positioned close to the ion-exchange membrane, thereby connecting the ion-exchange membrane and the current collector to form a unitary assembly. The powder of β-lead dioxide is an electrode active material having a higher overpotential than oxides of platinum group metals, so the electrode structure of the present invention is useful in various types of electrolysis such as those involved in the production of ozone by electrolysis of water, the production of peroxides by electrolysis of aqueous solutions and in the electrolytic oxidation of organic matter. These type of electrolysis require higher cell voltages than the production of alkali hydroxides by electrolysis of alkali halides, or the production of oxygen and hydrogen by electrolysis of water.

Having the arrangement described above, the electrode structure of the present invention offers the following advantages. First, reliable contact is assured between current collectors and the electrodeposited layer of lead dioxide serving as an electrode active material, thereby obviating the need to install a separate means for maintaining the contact between the two members. In addition, there are no current fluctuations which would otherwise occur in the presence of marginal contact and a constant supply of electric current is ensured to enable consistent electrolysis operations.

Secondly, unlike conventional SPE type electrodes, the connection between a current collector, an electrode active material and an ion-exchange membrane can be realized by standardized unit operation and this contributes greatly to an improvement in the operational efficiency of electrode fabrication.

Thirdly, the electrode structure of the present invention can be fabricated without high temperature processing of the ion-exchange membrane. Therefore, this electrode is free from thermal deterioration of the ion-exchange membrane and provides a higher degree of ruggedness.

Fourthly, the electrode structure of the present invention has a substantially three-dimensional extended electrodeposited layer of lead dioxide which increases the area over which the reactants can make contact with the electrode active material, thereby contributing to an improvement in current efficiency and a decrease in cell voltage.

Fifthly, the porosity of the lead dioxide layer and the degree of its gas permeability can be controlled by incorporating particles in the layer. Therefore, an electrode apparatus that is adapted for a specific use can be easily fabricated.

If an adhering layer having fine particles chiefly containing β-lead dioxide powder is formed on an ion-exchange membrane, the lead dioxide layer subsequently deposited and serving as an electrode active material is blocked by the adhering layer in such a way that it is not unevenly penetrated into the ion-exchange membrane during electrodeposition. As a result, not only are side reactions inhibited, but the adhesion between the electrodeposited layer, adhering layer and the ion-exchange membrane is improved.

The following examples are provided for the purpose of further illustrating the electrode structure of the present invention but are in no way to be taken as limiting.

EXAMPLE 1

A commercial cation-exchange membrane of the perfluorosulfonic acid type (manufactured by du Pont and sold under the tradename "Nafion 117") was surface roughened with #1000 emery paper, immersed in a 5 wt.% aqueous solution of nitric acid to convert the sulfonic acid groups in the membrane to a hydrogen (H) type, and assembled as a diaphragm in a two-compartment electrolytic cell. The membrane was placed in the cell for 24 hours, with one compartment being filled with an aqueous solution of chloroplatinic acid (5 g/l) and the other compartment with an aqueous solution of hydrazine (10 g/l), thereby forming a platinum layer on one side of the membrane. In a separate step, β-lead dioxide that had been prepared by electrolysis of a lead nitrate solution was ground into particles in an agate mortar and sieved to obtain fine particles of 250 mesh pass. These particles were kneaded with a perfluorinated ion-exchange resin in an aqueous suspension of polytetrafluoroethylene (PTFE) (manufactured by Mitsui Fluorochemicals Co., Ltd. and sold under the tradename "30J") to form a paste, which was coated with a brush on the side of the ion-exchange membrane opposite to that having the platinum layer. The membrane was left to stand at room temperature, and had its surfaces smoothed and pressed at a temperature of 160° C. The ion-exchange membrane thus prepared has a platinum layer formed on one side and a layer of β-lead dioxide adhering to the other side. This membrane was reassembled into a two-compartment electrolytic cell for performing electrolysis at 60° C. for 2 hours at a current density of 2A/dm$^2$, with the compartment on the β-lead dioxide side being filled with an aqueous solution of lead nitrate (400 g/l). The cathode was the platinum layer on the membrane, and the anode was a titanium plate disposed in contact with the adhering layer of β-lead dioxide.

Two current collectors were placed in close contact with the electrode structure, one being made of platinum-plated porous nickel and disposed on the cathode side, and the other being made of a β-lead dioxide coated titanium screen and disposed on the anode (lead dioxide) side. Using this arrangement, electrolysis was conducted with deionized water being charged on the anode side. Oxygen gas containing 14% ozone was produced at 20° C. and at a current density of 100 A/dm$^2$. The cell voltage was constant at 3.7 volts throughout the electrolysis.

EXAMPLE 2

As in Example 1, a platinum layer was deposited on one side of an ion-exchange membrane. In a separate step, particles of β-lead dioxide of 345 mesh pass were kneaded with ethyl alcohol to form a paste, which was coated on the side of the ion-exchange membrane opposite to that having the platinum layer. The membrane was left to dry at room temperature and then had its surfaces smoothed and pressed at a temperature of 160° C. Thereafter, an electrodeposited layer of lead dioxide was formed on the β-lead dioxide layer by electrolysis as in Example 1. The electrode structure of the SPE type thus formed was assembled into an electrolytic cell of the same type as used in Example 1 and electrolysis was performed with the anode compartment being filled with deionized water. Oxygen gas containing 12% ozone was obtained at 20° C. and at a current density of 100A/dm$^2$. The cell voltage was constant at 4.2 volts throughout the electrolysis.

EXAMPLE 3

An ion-exchange membrane of the same type as used in Example 1 was surface activated by sputtering with argon ions. The membrane was then converted to a hydrogen (H) type by immersion in a 5 wt % aqueous solution of nitric acid and assembled into a two-compartment electrolytic cell. A platinum coating on one side of the membrane was formed as in Example 1.

A mixture of fine particles of β-lead dioxide prepared by electrolysis, particles of titanium oxide and zirconium oxide were partially reduced by treatment in vacuum at 1100° C. for 6 hours. The resulting fine particles were kneaded with an aqueous suspension of PTFE to prepare a paste, which was then coated on the ion-exchange membrane as in Example 1 to form an adhering layer.

The ion-exchange membrane thus formed was reassembled into a two-compartment electrolytic cell. An electrodeposited layer of β-lead dioxide containing fine particles of the same composition as that of the paste was formed on the β-lead dioxide containing adhering layer. The electrolysis conditions were 65° C. and a current density of 2A/dm$^2$, with the adhering layer being exposed to an aqueous electrolyte solution of lead nitrate (400 g/l) having the fine particles suspended therein.

The resulting electrode structure of the SPE type was assembled into an electrolytic cell as in Example 1 for performing electrolysis of deionized water. Oxygen gas containing 16% ozone was obtained in the anode compartment at 20° C. and at a current density of 100A/dm$^2$. The cell voltage was constant at 3.6 volts throughout the electrolysis.

EXAMPLE 4

A current collector was prepared by welding a screen of expanded pure titanium of fine mesh (major axis, 2.5 mm; minor axis, 1.6 mm) having a thickness of 0.3 mm to the surface of another screen of expanded pure titanium 1.5 mm thick. This collector was also welded to a flange made of a titanium plate. The weldment was degreased and pickled for 3 minutes with a 20 wt % boiling aqueous solution of HCl. Following pretreatment, the titanium plate was coated with a primer of platinum titanium-tantalum (25/60/15 mol %) by a conventional thermal decomposition method.

A coating of α-lead dioxide was formed on the collector by performing electrolysis at 40° C. for 30 minutes at a current density of 1A/dm$^2$. Lead oxide dissolved in a 30 wt % aqueous solution of caustic soda was used as an electrolyte. The titanium screen having the primer coating served as the anode.

In a separate step, a solid polymer electrolyte commercial cation-exchange resin of the perfluorosulfonic acid type (Nafion 117) was surface roughned with #1000 emery paper, brush-coated on one side with an isopropy alcohol solution of chloroplatinic acid (Pt content=50 g/l), and subjected to thermal decomposition at 250° C. to form a platinum coating on the treated side.

The ion-exchange membrane was assembled into a two-compartment electrolytic cell and platinum-coated porous nickel (manufactured by Sumitomo Electronic Industries, Ltd., sold under the tradename "Celmet") was positioned as a current collector on the Pt-coated side of the membrane. The current collector in the form of welded screens of expanded titanium was placed in close contact with the ion-exchange membrane on the side opposite to the platinum coating. In a separate step, particles of β-lead dioxide of 250 mesh pass were prepared by electrolysis. Using an electrolyte of an aqueous solution of lead nitrate (400 g/l) having β-lead dioxide particles suspended therein and which also contained a very small amount of PTFE particles, an electric current was passed through the membrane at a density of 2A/dm$^2$, with the titanium current collector and the Pt-coated nickel serving as anode and cathode respectively. The temperature was held constant at 60° C.

After passage of current for 8 hours, an electrodeposited layer of porous lead dioxide having a total thickness of about 2 mm was formed on the current collectors. Besides β-lead dioxide, white fibers presumably of PTFE were observed on this electrodeposited layer of lead dioxide. The resulting electrode structure comprised an ion-exchange membrane adhered integrally to the current collector by way of the electrodeposited layer of lead dioxide to form a unitary assembly.

This electrode structure was cleaned, and the two-compartment electrolytic cell was charged with deionized water. Electrolysis was conducted at a temperature of 20°C. and at a current density of 100A/dm$^2$ with the electrodeposited layer of lead dioxide serving as the anode. Oxygen gas containing 14% ozone was produced at the anode. The cell voltage was constant at 3.6 volts throughout the electrolysis.

EXAMPLE 5

An ion-exchange membrane having a platinum layer deposited on one surface and an anode current collector provided with a primer coating were prepared as in Example 4. The ion-exchange membrane was assembled as a diaphragm into a two-compartment electrolytic cell. A coating of α-lead dioxide as in Example 4 was formed on the anode current collector as positioned 0.5 to 1 mm away from the ion-exchange membrane. In a separate step, particles of β-lead dioxide of 200 mesh pass were prepared by electrolysis of a lead nitrate solution. The anode compartment was filled with an aqueous solution of lead nitrate (400 g/l) having these particles of β-lead dioxide suspended therein. Thereafter, electrolysis was performed at 60° C. for 6 hours at 4A/dm$^2$, with the anode current collector serving as the anode and with the platinum current collector as prepared in Example 4 being positioned as counter the electrode (cathode). As a result, an electrode structure was fabricated in which the anode current collector was integrally connected to the ion-exchange membrane via the porous electrodeposited layer of lead dioxide.

The anode compartment of the electrolytic cell was charged with deionized water for performing electrolysis at a temperature of 20° C. and at a current density of 100A/dm$^2$. Oxygen gas containing 14% ozone was obtained. The cell voltage was constant at 3.7 volts during the electrolysis.

EXAMPLE 6

An ion-exchange membrane was subjected to preliminary treatments as in Example 4. This membrane was assembled as a separator into a two-compartment electrolytic cell and left to stand in the cell for 24 hours, with one compartment being filled with an aqueous solution of chloroplatinic acid (5 g/l) and the other compartment with an aqueous solution of hydrazine (10 g/l), thereby forming a platinum layer on one side of the membrane.

After withdrawing the electrolytes from the cell, the ion-exchange membranes was thoroughly cleaned, and Pt-coated porous nickel was positioned in close contact with the platinum layer on the membrane. In a separate step, a current collector was prepared as in Example 4 so that a layer of lead dioxide was formed on its surface. This collector was positioned in close contact with the membrane on the side opposite the Pt-coated porous nickel.

After charging an aqueous solution of lead nitrate (400 g/l) containing a suspension of β-lead dioxide (10 g/l) and a perfluorinated ion-exchange resin solution (10 ml/l) in the electrolytic compartment remote from the Pt layer on the membrane, an electric current was passed between the two collectors, with the Pt layer serving as the cathode. By applying a current for 4 hours at a density of 4A/dm$^2$, an electrodeposited layer of lead dioxide containing particles chiefly composed of β-lead dioxide was formed, thus producing an electrode structure in which the ion-exchange membrane was integrally attained to the anode current collector via the electrodeposited layer containing particles of β-lead dioxide.

The electrolytes were withdrawn from the electrolytic cell, and the latter was thoroughly cleaned. Thereafter, electrolysis was performed at a current density of 100A/dm$^2$ using deionized water as an electrolyte. Oxygen gas containing 16% ozone was produced in the anode compartment. The cell voltage was constant at 3.6 volts throughout the electrolysis.

EXAMPLE 7

An electrode structure was fabricated as in Example 6 except that the suspension was replaced by a mixture of β-lead dioxide and fluorinated carbon. The structure was assembled into an electrolytic cell and electrolysis wa performed at 50A/dm$^2$ with deionized water being charged into the anode compartment. Oxygen gas containing about 9% ozone was produced in the anode compartment. The cell voltage was constant at 3.3 volts throughout the electrolysis.

EXAMPLE 8

A commercial cation-exchange membrane of the perfluorosulfonic acid type (Nafion 117) was surface roughened with #1000 emery paper, immersed in a 5 wt % aqueous solution of nitric acid to convert the sulfonic acid groups in the membrane to a hydrogen (H) type, and assembled as a diaphragm into a two-compartment electrolytic cell. The membrane was left to stand in the cell for 24 hours, with one compartment being filled with an aqueous solution of chloroplatinic acid (5 g/l) and the other compartment with an aqueous solution of hydrazine (10 g/l), thereby forming a platinum layer on one side of the membrane.

In a separate step, β-lead dioxide that had been prepared by electrolysis of a lead nitrate solution was ground into particles in an agate mortar and sieved to obtain fine particles of 250 mesh pass. These particles were kneaded with a perfluorinated ion-exchange resin in an aqueous suspension of PTFE (30J) to form a paste, which was brush-coated on the side of the ion-exchange membrane opposite to that having the platinum layer. The membrane was left to dry at room temperature and its surface was smoothed and pressed at a temperature of 160° C.

A titanium current collector was provided with a primer coating as in Example 4, and a coating layer of α-lead dioxide was also formed on the primer as in Example 4.

The ion-exchange membrane was assembled into a two-compartment electrolytic cell, and platinum-coated porous nickel (Celmet) was placed as a current collector in close contact with the Pt-coated side of the membrane. The titanium current collector having a coating of β-lead dioxide was placed in close contact with the opposite side of the membrane (i.e., the side where the adhering layer of β-lead dioxide was formed). After charging an aqueous solution of lead nitrate (400 g/l) into the side having the lead dioxide adhering layer of the membrane, electrolysis was performed for 4 hours at a current density of 4A/dm$^2$ with the lead dioxide coated Ti current collector being used as an anode. As a result, an electrode structure having an integral assembly of the ion-exchange membrane and the current collectors was obtained.

The electrolytes were then withdrawn from the electrolytic cell, and the latter was thoroughly cleaned with deionized water. Thereafter, deionized water was charged into the side having the lead dioxide layer, and current was passed at a density of 100A/dm$^2$. The temperature of the electrolyte was 20° C. and the cell voltage was 3.6 volts. As a result of this electrolysis, oxygen gas containing 16% ozone was produced in the anode compartment.

EXAMPLE 9

An electrode structure was fabricated as in Example 8 except that a mixture of an aqueous suspension of PTFE (1 g/l) and an aqueous solution of nitric acid (400 g/l) having fine particles of β-lead dioxide suspended therein was used in the formation of an electrodeposited layer of lead dioxide by electrolysis.

The electrode structure thus formed was assembled into a two-compartment electrolytic cell, and deionized water was charged at the side having the lead dioxide layer. Thereafter, electrolysis was performed by passing an electric current at a density of 100A/dm$^2$ with the lead dioxide as the anode. The cell voltage was 3.5 volts, and oxygen gas containing 15% ozone was produced in the anode compartment.

While the invention has been described in detail and with reference to specific embodiments thereof, it will be apparent to one skilled in the art that various changes and modifications can be made therein without departing from the spirit and scope thereof.

What is claimed is:

1. An electrode composite structure of a solid polymer electrolyte type for use in electrolysis comprising: an ion-exchange membrane serving as a solid polymer electrolyte and having two opposite surface; an adhering layer having particles containing β-lead dioxide powder formed on one surface; and an electrodeposited layer of lead dioxide on said adhering layer.

2. An electrode composite structure according to claim 1, wherein said particles are a mixture of β-lead dioxide and an electrolytic cocatalyst.

3. An electrode composite structure according to claim 2, wherein said electrolytic cocatalyst is at least one member selected from the group consisting of a fluorine resin, a perfluorosulfonic acid type ion-exchange resin, fluorinated carbon, carbon, and an oxide of at least one of titanium, zirconium, niobium and tantalum.

4. An electrode composite structure according to claim 2, wherein said electrolytic cocatalyst is present in an amount of from 0.1 to 20 wt % based on the weight of β-lead dioxide.

5. An electrode composite structure of a solid polymer electrolyte type for use in electrolysis comprising: an ion-exchange membrane serving as a solid polymer electrolyte and having two opposite surfaces; an adhering layer having particles containing β-lead dioxide - powder formed on one surface; and an electrodeposited layer of lead dioxide on said adhering layer having particles containing β-lead dioxide powder dispersed therein.

6. An electrode composite structure according to claim 5, wherein said particles of said adhering layer, said electrodeposited layer or said adhering layer and said electro deposited layer are a mixture of β-lead dioxide and an electrolytic cocatalyst.

7. An electrode composite structure according to claim 6, wherein said electrolytic cocatalyst is at least one member selected from the group consisting of a fluorine resin, a perfluorosulfonic acid type ion-exchange resin, fluorinated carbon, carbon, and an oxide of at least one of titanium, zirconium, niobium and tantalum.

8. An electrode composite structure according to claim 6, wherein said electrolytic cocatalyst is present in an amount of from 0.1 to 20 wt % based on the weight of β-lead dioxide.

9. An electrode composite structure of a solid polymer electrolyte type for use in electrolysis in which an electrodeposited layer of lead dioxide having dispersed therein fine particles loaded with a β-lead dioxide powder is formed electrolytically between an ion-exchange membrane serving as a solid polymer electrolyte and a current collector positioned close to said ion-exchange membrane, thereby connecting said ion-exchange membrane and said current collector to form a unitary assembly.

10. An electrode composite structure according to claim 9, wherein the fine particles dispersed in said electrodeposited layer of lead dioxide are a mixture of β-lead dioxide and an electrolytic cocatalyst.

11. An electrode composite structure according to claim 10, wherein said electrolytic cocatalyst is at least one member selected from the group consisting of a fluorine resin, a perfluorosulfonic acid type ion-exchange resin, fluorinated carbon, carbon, and an oxide of at least one of titanium, zirconium, niobium and tantalum.

12. An electrode composite structure according to claim 9, wherein an adhering layer containing fine particles loaded with a β-lead dioxide powder is first formed on the surface of the ion-exchange membrane, the electrodeposited layer of lead dioxide being then formed electrolytically between said adhering layer and the current collector.

13. A process for fabricating an electrode composite structure of a solid polymer electrolyte type for use in electrolysis which comprises the following steps: positioning a current collector close to an ion-exchange membrane serving as a solid polymer electrolyte; positioning a counter-electrode on the side of said ion-exchange membrane which is remote from said current collector serving as an anode; performing electrolysis using as an electrolyte a lead salt solution having particles of β-lead dioxide dispersed therein, so as to form an electrodeposited layer of lead dioxide in which fine particles containing said particles of β-lead dioxide are dispersed, thereby connecting said ion-exchange membrane and said current collector by said electrodeposited layer of lead dioxide to form a unitary assembly.

14. A process according to claim 13, wherein the electrolyte is an aqueous solution of lead nitrate having a concentration of 200 to 500 g/l which has particles of β-lead dioxide suspended in an amount of 3 to 30 wt %.

15. A process according to claim 13, wherein an adhering layer containing fine particles loaded with a β-lead dioxide powder is first formed on the surface of the ion-exchange membrane, and the electrodeposited layer of lead dioxide is then formed electrolytically between said adhering layer and the current collector.

* * * * *